US010842709B2

(12) United States Patent
Taylor

(10) Patent No.: US 10,842,709 B2
(45) **Date of Patent: *Nov. 24, 2020**

(54) SELF-MASSAGE ROLLER AND BOTTLE

(71) Applicant: Lani Taylor, Santa Monica, CA (US)
(72) Inventor: Lani Taylor, Santa Monica, CA (US)

( * ) Notice: Subject to any disclaimer, the term of this patent is extended or adjusted under 35 U.S.C. 154(b) by 397 days.

This patent is subject to a terminal disclaimer.

(21) Appl. No.: 15/827,310
(22) Filed: Nov. 30, 2017
(65) Prior Publication Data

US 2018/0078446 A1 Mar. 22, 2018

Related U.S. Application Data

(63) Continuation of application No. 14/304,759, filed on Jun. 13, 2014, now Pat. No. 9,861,551.
(Continued)

(51) Int. Cl.
*A61H 15/00* (2006.01)
*A47G 19/22* (2006.01)

(52) U.S. Cl.
CPC ..... *A61H 15/0092* (2013.01); *A47G 19/2227* (2013.01); *A61H 2015/0014* (2013.01);
(Continued)

(58) Field of Classification Search
CPC ..... A61H 15/0092; A61H 2201/1695; A61H 2201/1284; A61H 2015/0014
See application file for complete search history.

(56) References Cited

U.S. PATENT DOCUMENTS 5,022,562 A 6/1991 Lurkis et al.
5,873,478 A 2/1999 Sullivan et al.
(Continued)

FOREIGN PATENT DOCUMENTS

CN 203107615 U 8/2013
CN 104706512 B 4/2019
(Continued)

OTHER PUBLICATIONS

Wagner, T., "Stainless Steel Water Bottles: Everything You Need to Know" Article, Sustainable Baby Steps, Jul. 30, 2012. pp. 1-3, United States [downloaded from URL:http://web.archive.orgjweb/20120730020305/http://www.sustainablebabysteps.comjstainless-steel-water-bottles.html on Jun. 12, 2017].
(Continued)

*Primary Examiner* — Bradley H Philips
*Assistant Examiner* — Savannah L Gabriel
(74) *Attorney, Agent, or Firm* — Sherman IP LLP; Kenneth L. Sherman; Hemavathy Perumal

(57) ABSTRACT

A self-massage roller having a bottle, a covering, and, optionally, a removable cap. The bottle provides a vessel for holding liquids. The covering includes a base layer and a plurality of nubs. The base layer overlays the outer surface of the bottle. Each nub in the plurality of nubs protrudes from the base layer in a direction radially away from the outer surface of the bottle. Each nub is a massage element, and the plurality of nubs forms a textured surface for myofascial release of certain muscles of the user. In another version, each nub is attached directly to the outer surface of the bottle without an intervening base layer. In versions with a cap, the cap may include a flip-up spout, or it may have a plunger valve that opens upon pulling the plunger outward and closes upon pushing in the plunger.

20 Claims, 12 Drawing Sheets

Related U.S. Application Data

(60) Provisional application No. 61/875,696, filed on Sep. 10, 2013.

(52) U.S. Cl.
CPC ..... *A61H 2201/1284* (2013.01); *A61H 2201/1695* (2013.01)

(56) References Cited

U.S. PATENT DOCUMENTS

| | | | | |
|---|---|---|---|---|
| 6,129,687 | A * | 10/2000 | Powell | A61H 15/02 220/4.07 |
| 6,354,458 | B1 | 3/2002 | Policappelli | |
| D471,636 | S | 3/2003 | Yu et al. | |
| 8,181,816 | B2 | 5/2012 | Allen | |
| D693,934 | S | 11/2013 | Lin | |
| 9,005,146 | B2 * | 4/2015 | Phillips | A61H 15/0092 482/132 |
| 9,861,551 | B2 | 1/2018 | Taylor | |
| 2003/0010744 | A1 * | 1/2003 | Ma | A61H 15/0092 215/382 |
| 2003/0225352 | A1 | 12/2003 | Eckers et al. | |
| 2004/0243036 | A1 | 12/2004 | Ma et al. | |
| 2005/0015032 | A1 * | 1/2005 | Stein | A61H 15/02 601/131 |
| 2006/0000277 | A1 | 1/2006 | Pietrorazio et al. | |
| 2007/0129654 | A1 | 6/2007 | Anderson, Jr. | |
| 2009/0112137 | A1 * | 4/2009 | Lamore | A63B 21/0004 601/112 |
| 2010/0193390 | A1 | 8/2010 | Moretti | |
| 2012/0094261 | A1 | 4/2012 | Hayn et al. | |
| 2012/0277077 | A1 | 11/2012 | Hsu et al. | |
| 2013/0096472 | A1 | 4/2013 | Bertram et al. | |
| 2013/0310234 | A1 | 11/2013 | Miller | |

FOREIGN PATENT DOCUMENTS

| | | | |
|---|---|---|---|
| CN | 110025464 | A | 7/2019 |
| HK | 40009065 | A | 6/2020 |
| TW | 201906593 | A | 2/2019 |
| TW | I650115 | B | 2/2019 |
| WO | 2015038541 | A1 | 3/2015 |

OTHER PUBLICATIONS

Extended European Search Report dated May 4, 2017 for European Application No. 14844367.4 from European Patent Office, pp. 1-10, Munich, Germany.

European Office Action dated Oct. 16, 2019 for European Application No. 14844367.4 from European Patent Office, pp. 1-5, Munich, Germany.

Facebook, Website of Photo I: https://www.facebook.com/mobotnation/photos/a.688084361202865.1073741829.685872111424090/688084257869542/?type=3&theater, Publication date of Photo I: Nov. 9, 2013.

Facebook, Website of Photo II: https://www.facebook.com/mobotnation/photos/a.688084361202865.1073741829.685872111424090/693169627361005/?type=3&theater, Publication date of Photo II: Nov. 17, 2013.

Supplemental European Search Report dated Jul. 11, 2017 for European Application No. 14844367.4 from European Patent Office, pp. 1, Munich, Germany.

Chinese Office Action dated Sep. 28, 2017 for Chinese Patent Application No. 201410459138.8 from Chinese Patent Office, pp. 1-9, Beijing, China.

Chinese Office Action dated May 23, 2018 for Chinese Patent Application No. 201410459138.8 from Chinese Patent Office, pp. 1-6, Beijing, China.

Chinese Notice of Allowance dated Dec. 25, 2018 for Chinese Patent Application No. 201410459138.8 from Chinese Patent Office, pp. 1-7, Beijing, China.

ROC (Taiwan) Office Action & Search Report dated May 30, 2018 for ROC (Taiwan) Patent Application No. 103131219 from ROC (Taiwan) Patent Office, pp. 1-11, Beijing, China.

ROC (Taiwan) Notice of Allowance dated Oct. 11, 2018 for ROC (Taiwan) Patent Application No. 103131219 from ROC (Taiwan) Patent Office, pp. 1-3, Beijing, China.

U.S. Non-Final Office Action for U.S. Appl. No. 14/304,759 dated Dec. 14, 2015.

U.S. Final Office Action for U.S. Appl. No. 14/304,759 dated Jun. 29, 2015.

U.S. Non-Final Office Action for U.S. Appl. No. 14/304,759 dated Jan. 27, 2017.

U.S. Notice of Allowance for U.S. Appl. No. 14/304,759 dated Aug. 30, 2017.

U.S. Corrected Notice of Allowability for U.S. Appl. No. 14/304,759 dated Sep. 25, 2017.

European Office Action dated May 12, 2020 for European Application No. 14844367.4 from European Patent Office, pp. 1-5, Munich, Germany.

ROC (Taiwan) Office Action & Search Report dated Dec. 26, 2019 for ROC (Taiwan) Patent Application No. 103131219 from ROC (Taiwan) Patent Office, pp. 1-12, Taiwan, R.O.C (English-language translation included pp. 1-5).

* cited by examiner

SELF-MASSAGE ROLLER AND BOTTLE

TECHNICAL FIELD

This invention relates to the field of exercise and mobility products, more particularly to bottles having exterior padding, and that are configured and adapted to function both as a vessel for holding liquids for consumption by a user and as a roller for myofascial flexibility and muscle tension release for the user.

BACKGROUND ART

Myofascial rollers have become an important piece of equipment in the field of exercise and mobility. Use of a foam roller provides numerous benefits to its user in terms of flexibility and decreasing muscle tension. A foam roller also can be used in warm up and recovery. Currently available rollers are normally large in size, causing portability problems. Typically, a person's equipment bag or usual carrying case or purse is very full with numerous items that one wishes to carry. And carrying around, in addition, an oversized foam roller is a problem for many.

Conventional rollers are normally cylindrical in shape and constructed from a variety of foams. As used in the field of exercise, a bottle is a vessel typically used for rehydration during or after exercise. Rehydration is extremely important for people's health and wellbeing.

Embodiments of the presently described self-massage roller and bottle solve problems associated with the conventional, relatively large, foam roller products by providing a drink bottle with a foam roller covering, and a lid having an easy pour spout. The presently described self-massage roller and bottle can be taken wherever the user requires hydration and myofascial release.

The self-massage roller and bottle is a single device with structures that provide for combined rehydration and myofascial release. As such, it serves to remind people to do both. With its relatively small size, it is convenient and can be taken virtually anywhere. And the integrated design saves space in the user's equipment bag, carrying case, or purse.

The presently described self-massage roller and bottles can be made in a variety of sizes, shapes and configurations; can have any of a variety of coverings made from different types of foams or to other materials; and the coverings can have any of a variety of surface configurations. Embodiments of the presently described self-massage roller and bottles can be manufactured in a range of sizes and can have different shapes, styles, and densities of foam coverings.

DISCLOSURE OF INVENTION

Embodiments of the present invention combine the traditional benefits of a foam roller with the traditional benefits of hydration by using a drink bottle. The invention uses a bottle as the core of the roller. The bottle is a vessel for liquid rehydration and also provides a very strong core for functioning as a foam roller.

Accordingly, one aspect of the invention can be viewed as a self-massage roller with bottle. This self-massage roller has a bottle and a covering. In versions of the invention, the self-massage roller with bottle also includes a removable cap. The bottle has a body, a bottom, and a top. The body has an outer surface, a top end, and a bottom end. The bottom closes the bottom end of the body. The top is at the top end of the body and allows access to the interior of the bottle.

The bottle is preferably formed from type-304 stainless steel having a wall thickness of 0.5 mm to provide strength sufficient to carry or support great weight needed for use in myofascial release. In some embodiments, the top includes a neck, which may be threaded to mate with a threaded cap.

In one version, the covering includes a base layer and a plurality of nubs. The base layer overlays the outer surface of the body. Preferably, the covering is relatively tightly positioned around a significant portion of the body and extends along the body for a significant portion of its top-to-bottom length. Each nub in the plurality of nubs protrudes from the base layer in a direction radially away from the outer surface of the body. Each nub is a massage element, and the plurality of nubs forms a textured surface for myofascial release of certain muscles of the user. Preferably, each nub is made of relatively dense synthetic foam, such as ethylene vinyl acetate (EVA).

In a version of the invention, the covering is applied to the bottle by way of a hot press mold and glue. In an embodiment, each nub is attached directly to the outer surface of the bottle without an intervening base layer.

In versions with a cap, the cap may include a flip-up spout, or it may have a plunger valve that opens upon pulling the plunger outward and closes upon pushing in the plunger. Other known designs are also suitable.

BEST MODE FOR CARRYING OUT THE INVENTION

Figure 1:
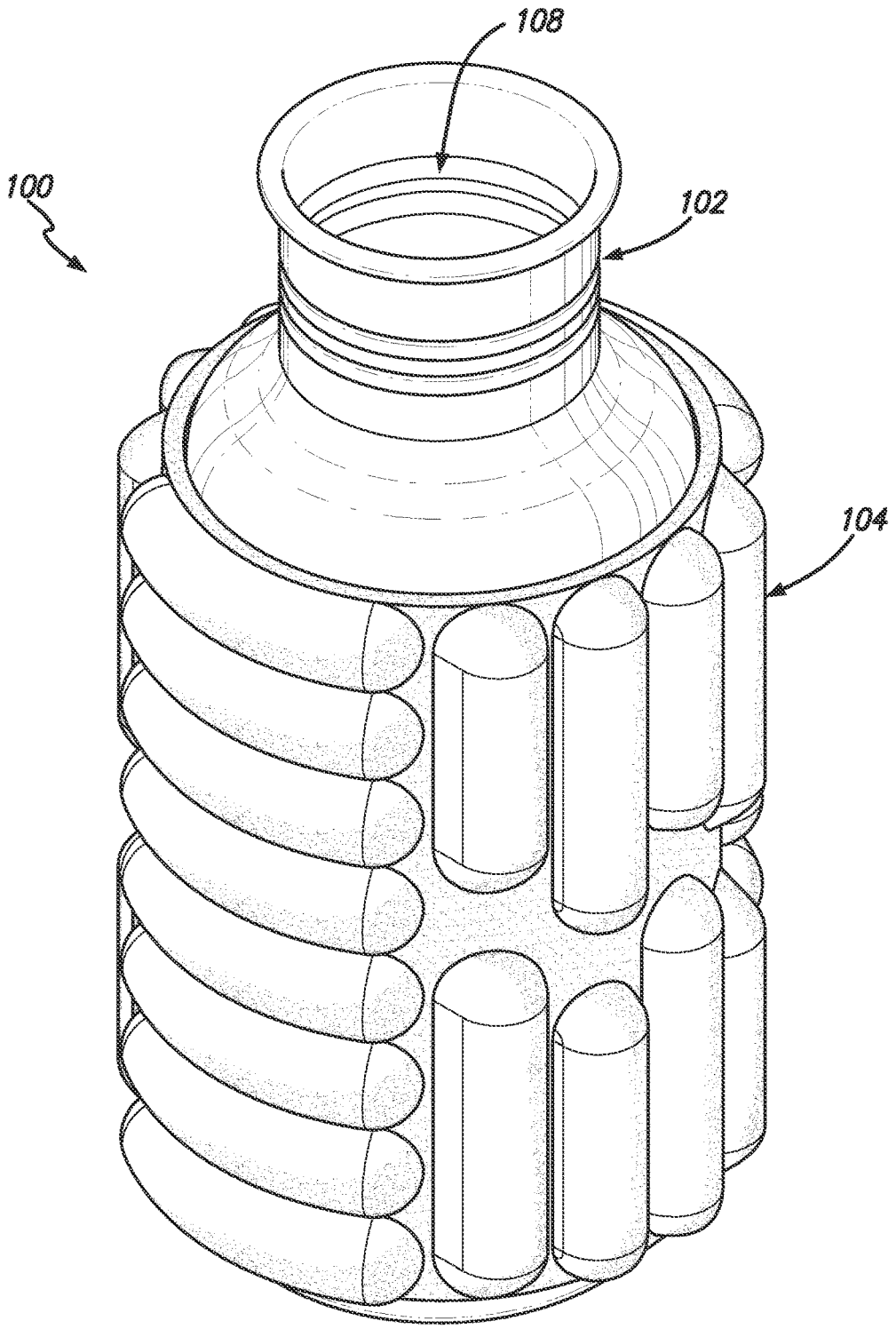
FIG. 1 is a perspective view of an embodiment of a Self-Massage Roller and Bottle.
Figure 2:
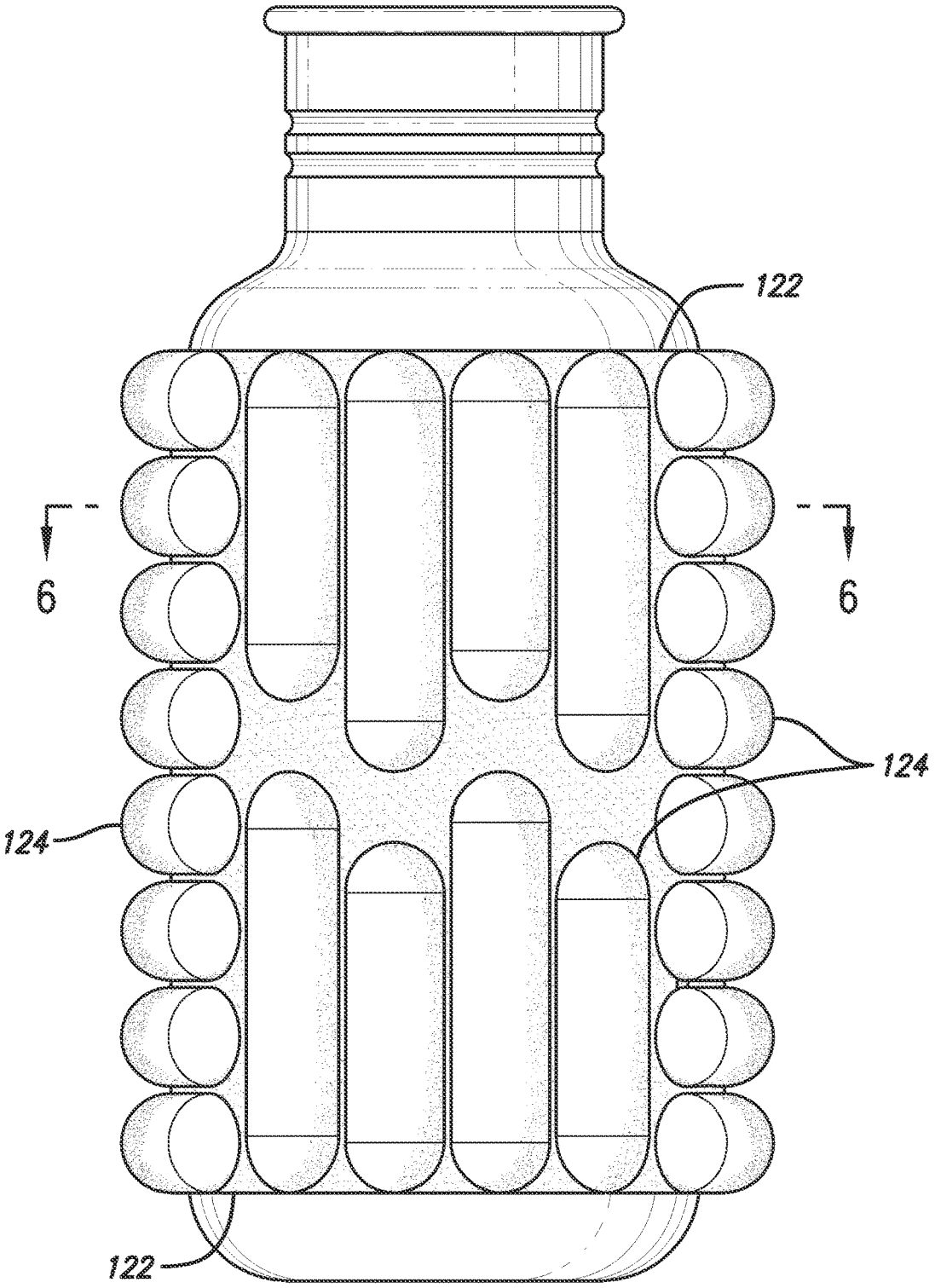
FIG. 2 is a front view of the embodiment of the Self-Massage Roller and Bottle shown in FIG. 1. The rear view is identical to this front view.
Figure 3:
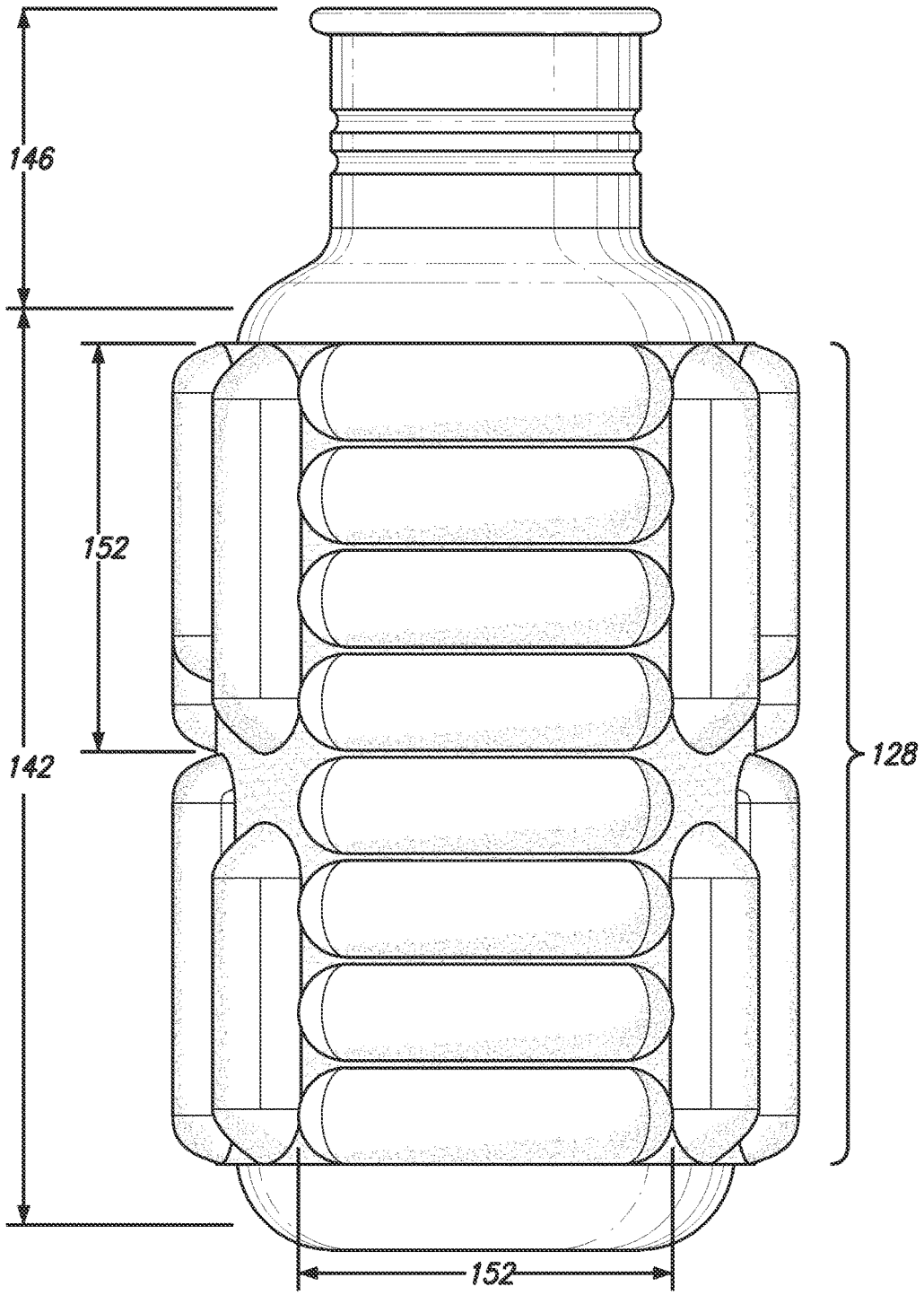
FIG. 3 is a right side view of the embodiment of the Self-Massage Roller and Bottle shown in FIG. 1. The left side view is identical to this right side view.
Figure 4:
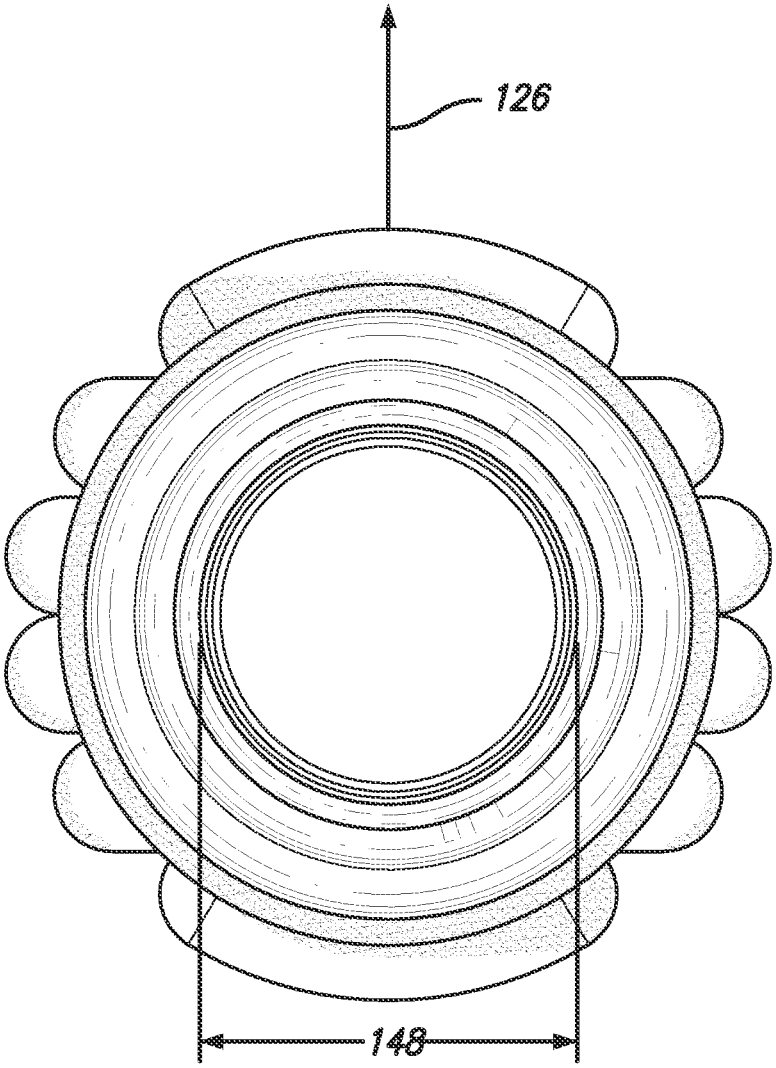
FIG. 4 is a top view of the embodiment of the Self-Massage Roller and Bottle shown in FIG. 1.
Figure 5:
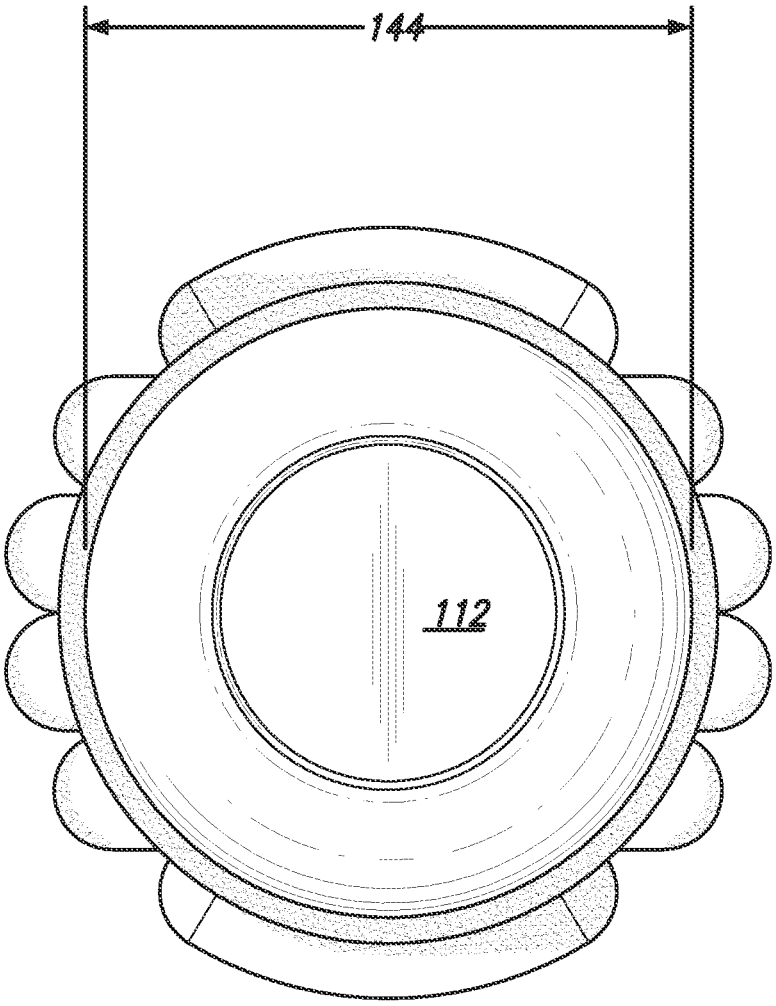
FIG. 5 is a bottom view of the embodiment of the Self-Massage Roller and Bottle shown in FIG. 1.
Figure 6:
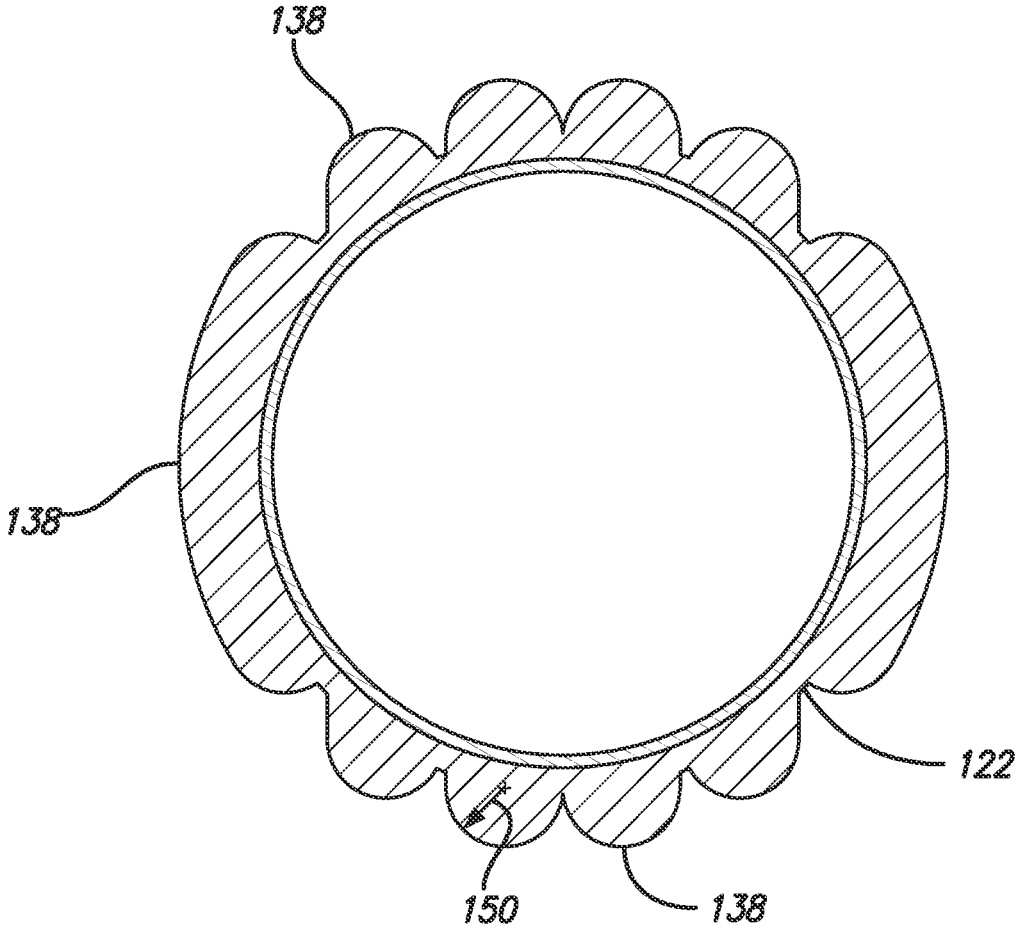
FIG. 6 is a cross section taken through the line indicated in FIG. 2, showing nubs having a semi-elliptical cross-section.
Figure 7:
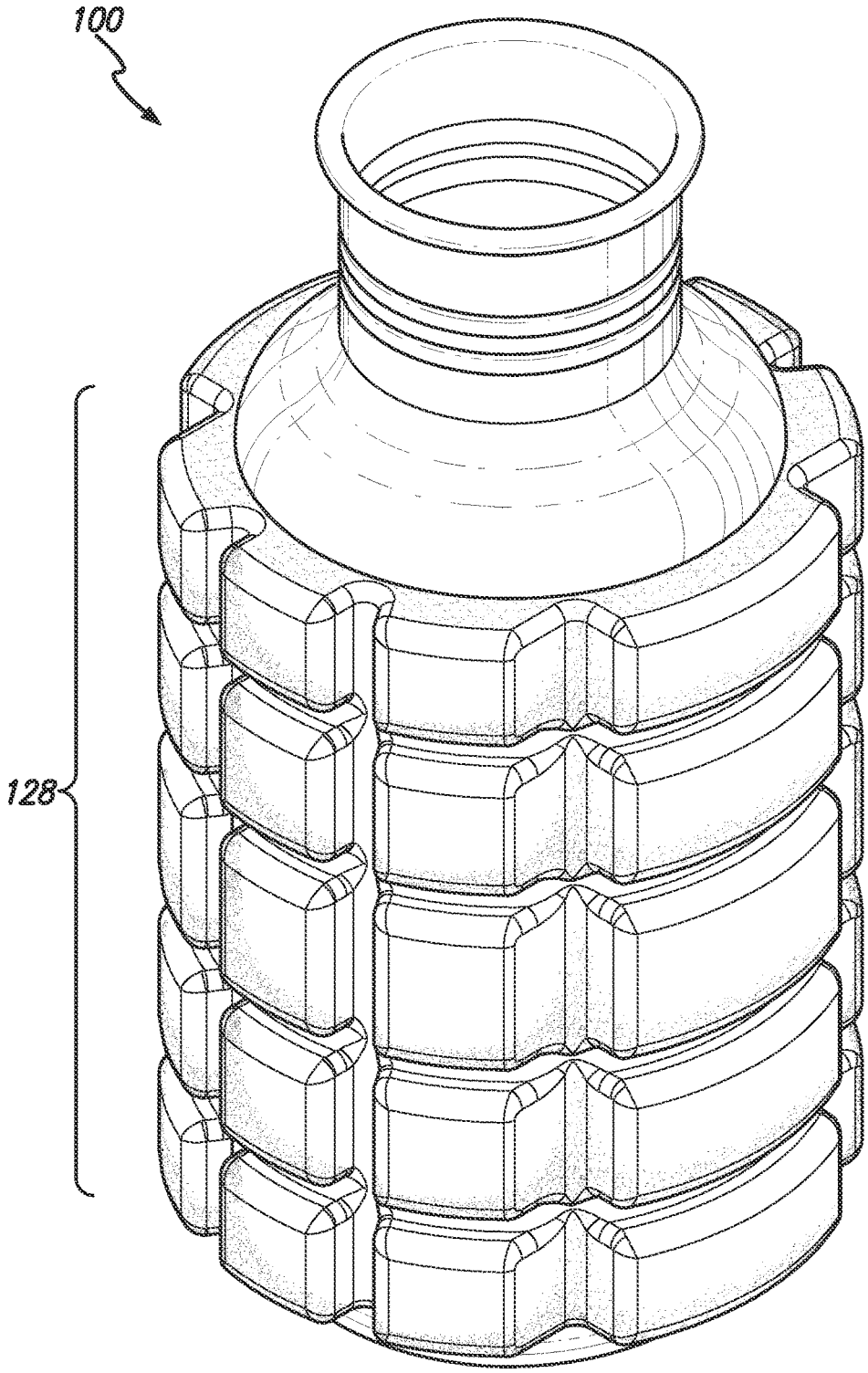
FIG. 7 is a perspective view of an alternative embodiment of a Self-Massage Roller and Bottle.
Figure 8:
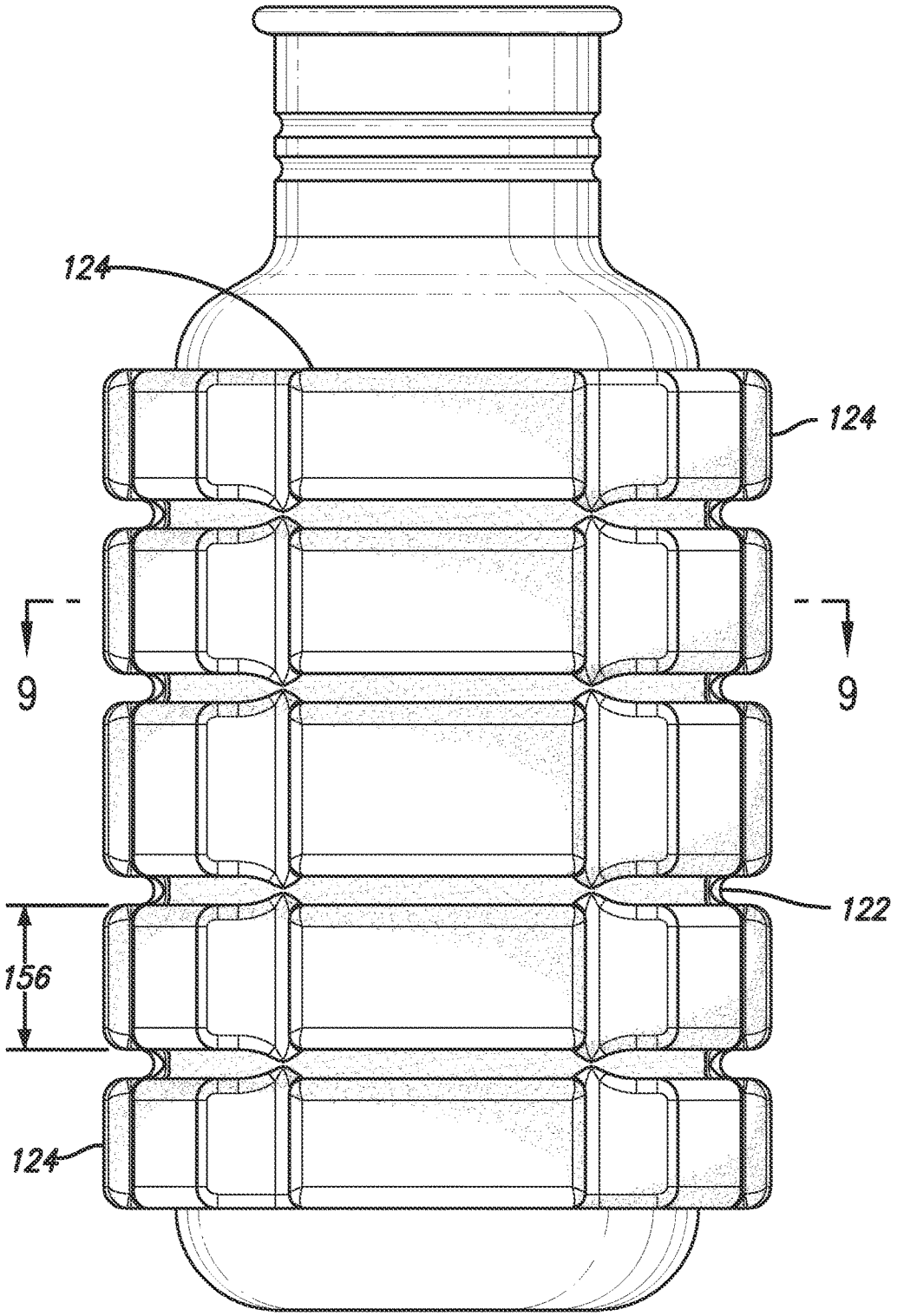
FIG. 8 is a front view of the embodiment of the Self-Massage Roller and Bottle shown in FIG. 7.
Figure 9:
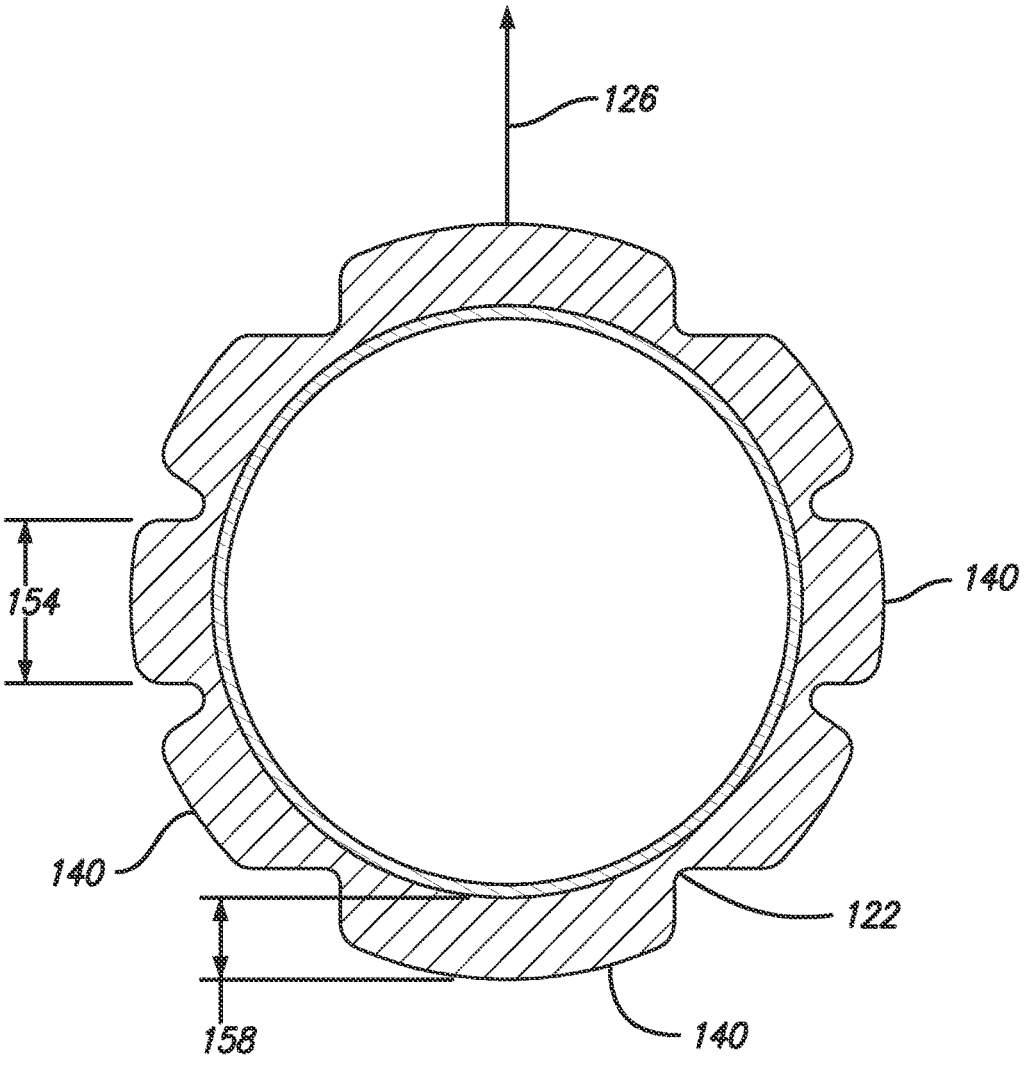
FIG. 9 is a cross section taken through the line indicated in FIG. 8, showing nubs having a trapezoidal cross-section.
Figure 10:
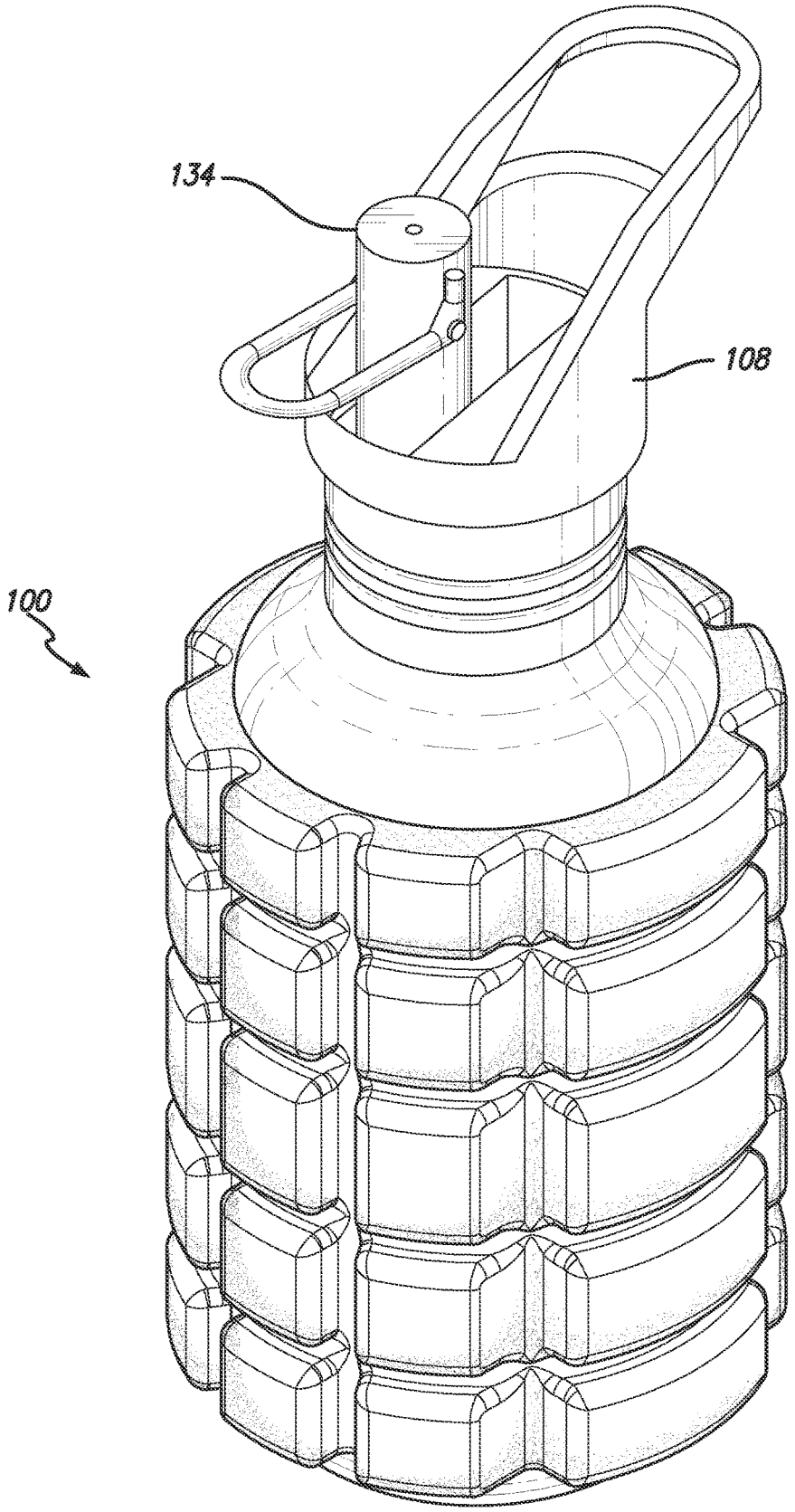
FIG. 10 is a perspective view of a version of the Self-Massage Roller and Bottle with a flip-up spout.
Figure 11:
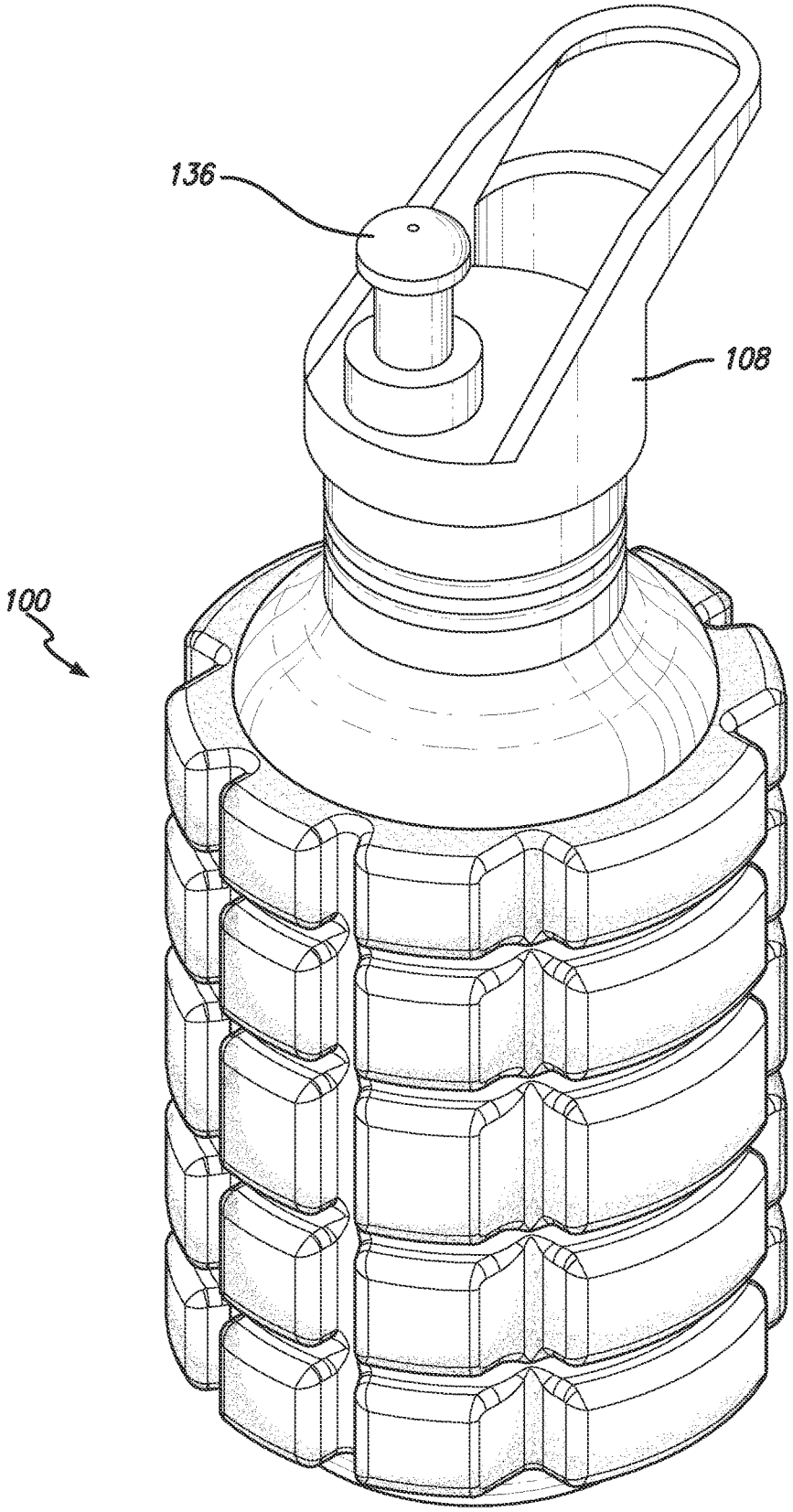
FIG. 11 is a perspective view of a version of the Self-Massage Roller and Bottle with a plunger valve.
Figure 12:
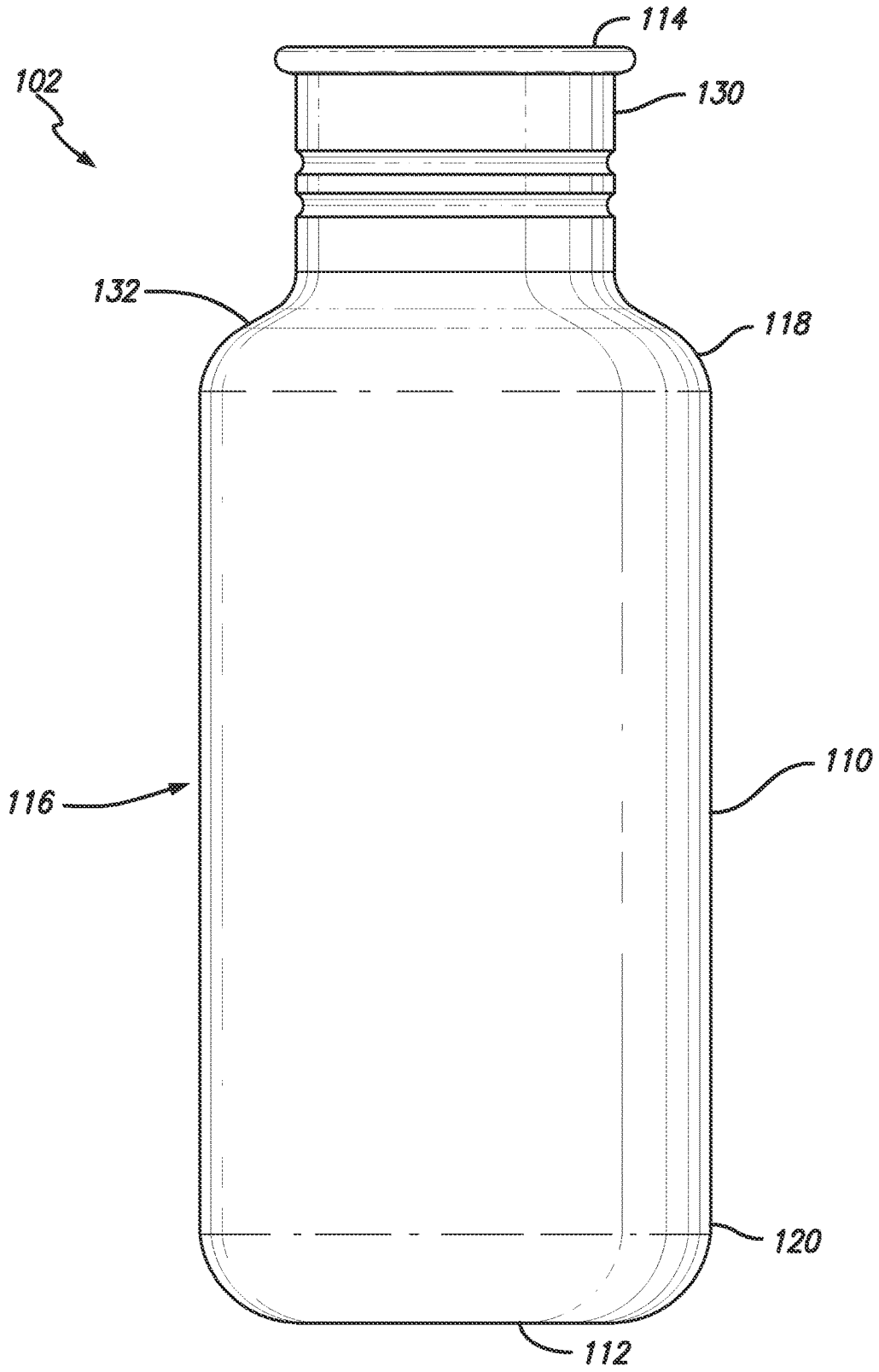
FIG. 12 is a front view of a version of the bottle, shown in isolation.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

By also referring to the drawings, the present invention is directed to a self-massage roller with bottle 100. The self-massage roller with bottle 100 has a bottle 102 and a covering 104. In versions of the invention, the self-massage roller with bottle 100 also includes a cap 106, which is preferably removable.

The bottle 102 has a body 110, a bottom 112, and a top 114. The body 110 has an outer surface 116, a top end 118, and a bottom end 120. The bottom 112 closes the bottom end 120 of the body 110. The top 114 is at the top end 118 of the body 110 and allows access to the interior 108 of the bottle 102. The body 110, the bottom 112, and the top 114 form the bottle 102, with access to the interior 108 of the bottle 102 through the top 114.

The bottle 102 is preferably formed from type-304 stainless steel having a wall thickness of 0.5 mm to provide sufficient strength to carry or support great weight needed for use in myofascial release. This wall thickness provides a bottle 102 that is stronger and more durable than the typical 0.3 mm to 0.4 mm thicknesses present in other steel bottles. However, other materials and thicknesses can be used if they provide sufficient strength to permit the bottle 102 to function as a myofascial release device, and if they can be used for bottles that contain liquids for human consumption. For example, the bottle 102 may be fashioned from synthetic fibers or synthetic composites. Preferably, the bottle 102 does not include Bisphenol A (BPA). In a version of the invention, the body 110 is a cylinder, and it may be a right circular cylinder. In some embodiments, the top 114 includes a neck 130, which is threaded in some versions. In some versions, the top 114 includes a tapered region 132, and the tapered region 132 joins the top end 118 of the body 110 to the neck 130.

The bottle 102 provides a vessel to carry rehydration liquid, such as water, energy drinks, protein shakes, and healthy green smoothies. The bottle 102 can vary in size, shape, and volume of capacitym as long as it can be used as a myofascial release device and contain liquids for human consumption. The presently preferred volumes of capacity are 12, 18, 27, and 40 ounces. The dimensions vary with the embodiment, but a bottle 102 having a capacity of about eighteen ounces typically has a bottle height 142 of 180 mm (about 7.1 inches), a body diameter 144 of 72.5 mm (about 2.9 inches), a top height 146 of 44 mm, and a neck diameter 148 of 44 mm.

The covering 104 includes a base layer 122 and a plurality of nubs 124. The base layer 122 overlays the outer surface 116 of the body 110. Preferably, the covering 104 is relatively tightly positioned around a significant portion of the body 110 and extends along the body 110 for a significant portion of its top-to-bottom length. In general the covering 104 extends over more than half of the length of the body 110 to provide sufficient surface area to contact a user's leg during use. Each nub in the plurality of nubs 124 protrudes from the base layer 122 in a direction radially away 126 from the outer surface 116 of the body 110. Each nub is a massage element, and the plurality of nubs 124 forms a textured surface 128 for myofascial release of certain muscles of the user. In some versions of the invention, the plurality of nubs 124 is at least fifteen nubs distributed about the base layer 122.

Preferably, each nub is made of relatively dense synthetic foam. Most preferably, the synthetic foam is ethylene vinyl acetate (EVA). However, materials of different densities can be used to offer the user a range of different massages for myofascial release by providing a relatively harder or softer feel. For example, the base layer 122 or the plurality of nubs 124 could be made from natural or synthetic rubber, including recycled rubber. It is also contemplated that materials with different densities may be used within a single self-massage roller with bottle 100 to provide a range of massages as the user rotates the self-massage roller with bottle 100.

While the surface texture and pattern for the plurality of nubs 124 may vary, the presently preferred embodiments are shown in the accompanying figures. The various surface textures and patterns offer the user a range of different massages. In some embodiments, each nub has a radial cross-section that is semi-elliptical 138. This includes cross-sections that semi-circular. In other embodiments, each nub has a radial cross-section that is trapezoidal 140. In yet another version, each nub has a radial cross-section that is semi-circular and each nub is arranged longitudinally on the outer surface 116, extending from near the top end 118 to near the bottom end 120 of the body 110. That embodiment was depicted in Provisional Application No. 61/875,696.

In the presently preferred embodiment where each nub has a radial cross-section that is semi-elliptical 138, the nub radius 150 preferably is between 7.0 mm (about 0.28 inches) and 8.5 mm (about 0.33 inches), and the nub length 152 preferably is between 49.5 mm to 59.5 mm. In the presently preferred embodiment where each nub has a radial cross-section that is trapezoidal 140, the nub length 154 preferably is 20 mm (about 0.79 inches) or 41 mm (about 1.6 inches), the nub width 156 preferably is 20 mm (about 0.79 inches), and the nub width 158 preferably is 7.0 mm (about 0.28 inches).

In a version of the invention, the covering 104 is applied to the bottle 102 by way of a hot press mold and glue. In an embodiment, each nub is attached directly to the outer surface 116 of the bottle 102 without an intervening base layer 122.

In versions with a cap 106, the cap 106 may include a flip-up spout 134, or it may have a plunger valve 136 that opens upon pulling the plunger outward and closes upon pushing in the plunger. Examples are shown in the Figures. Other spout designs are also effective, but the cap 106 preferably is a flip-up spout 134 made of BPA-free plastic. The cap 106 mates with the neck 130 to close the top 114 of the bottle 102.

The bottle 102 and cap 106 provide two methods of delivering liquid to the user. One is by completely unscrewing the cap 106 to remove it. The individual user can then drink directly from the top 114 of the bottle 102 or pour the liquid into another container, such as a cup. The second method, which provides faster access, is to use the flip-up spout 134 or another spout design. This is ideal for people who, for example, are exercising. Such people typically require a quick drink so they can continue their exercise. The bottle 102 can sit on its bottom 112, or lie down on its side outer surface 116.

Preferably, during non-use the self-massage roller with bottle 100 is intended to stand upright on its bottom 112, although it may be placed inside of carrying cases; so the orientation will vary. When used for myofascial release the self-massage roller with bottle 100 is placed on its side outer surface 116, horizontally on the floor or other surface. The user rolls the self-massage roller with bottle 100 on its side outer surface 116 on the floor, and has the user's body part (for example, a leg) positioned on top of at least a portion of the plurality of nubs 124. The user may press downward to increase the pressure applied to the body part, or the user may simply roll the self-massage roller with bottle 100 along the body part so that only gravity pressure is applied. In one aspect of use, the pressure is applied to the body part through the user rolling on the self-massage roller with bottle 100 and using the user's body weight to generate pressure on the body part(s) that contact the self-massage roller with bottle 100.

While the present invention has been described with regards to particular embodiments, it is recognized that additional variations of the present invention may be devised without departing from the inventive concept.

INDUSTRIAL APPLICABILITY

This invention may be industrially applied to the development manufacture, and use of bottles having exterior padding and that are configured and adapted to function both as a vessel for holding liquids for consumption by a user and as a roller for myofascial flexibility and muscle tension release for the user.

What is claimed:

1. A method for manufacturing a self-massage roller, comprising:

forming a bottle from stainless steel, wherein the bottle is configured to support a body weight of a user, and the bottle has a top-to-bottom length extending from a top end of the bottle to a bottom end of the bottle;

forming a covering comprising a base layer and a plurality of nubs; and overlaying the covering on a portion of an outer surface of the bottle;

wherein the plurality of nubs protrude from the base layer in a direction radially away from the outer surface of the bottle, the plurality of nubs together forming a textured surface for myofascial release, the plurality of nubs distributed about the base layer as alternating segments of at least two different surface textures, the alternating segments comprising at least one segment of a first surface texture and at least one other segment of a second surface texture;

wherein each segment of the first surface texture comprises a single array of nubs extending from a first side of the base layer to a second side of the base layer, all nubs of the single array having the same shape and dimensions, each nub of the single array vertically spaced apart from another nub of the single array, and all nubs of the single array arranged longitudinally along a first direction perpendicular to the top-to-bottom length of the bottle; and wherein each segment of the second surface texture comprises a first sequence of nubs with alternating nub lengths arranged in a first alternating order and a second sequence of nubs with alternating nub lengths arranged in a second alternating order that is complementary to the first alternating order, each nub of each sequence having a nub length that is either shorter or longer than another nub of the same sequence that is directly adjacent to the nub, each nub of each sequence horizontally spaced apart from another nub of the same sequence, all nubs of each sequence arranged longitudinally along a second direction parallel to the top-to-bottom length of the bottle, all nubs of each sequence having the same shape, and the first sequence disposed above the second sequence, such that each nub of the first sequence is positioned directly above and vertically spaced apart from another nub of the second sequence having a nub length that is either shorter or longer than the nub of the first sequence.

2. The method of claim 1, wherein the plurality of nubs having a radial cross-section that is semi-elliptical or trapezoidal.

3. The method of claim 1, wherein:

the bottle comprises a body including the outer surface, the top end, and the bottom end;

a bottom closing the bottom end; and a top at the top end to allow access to an interior of the bottle.

4. The method of claim 3, wherein:

the alternating segments are arranged longitudinally along different directions relative to the top-length of the bottle;

each nub of the first sequence of nubs includes a first nub end that is disposed along the first side of the base layer and that is in horizontal alignment with each other first nub end of each other nub of the first sequence; and each nub of the second sequence of nubs includes a second nub end that is disposed along the second side of the base layer and that is in horizontal alignment with each other second nub end of each other nub of the second sequence.

5. The method of claim 1, wherein the bottle has a wall thickness of 0.5 mm.

6. The method of claim 5, wherein the wall thickness of the bottle, dense material of each nub, and a nub length of each nub together support the body weight of the user when the roller is placed horizontally on a side of the outer surface and a body part of the user is positioned on top of a portion of the plurality of nubs.

7. The method of claim 1, wherein each nub includes a pair of opposing nub ends, and one or more opposing nub ends of one or more nubs of the plurality of nubs apply and sustain pressure on one or more body parts of the user when the one or more body parts roll on the roller and come in direct rolling contact with the one or more nubs, the one or more opposing nub ends massaging and releasing muscle tension from different muscle tissues of the one or more body parts.

8. The method of claim 1, wherein the alternating segments massage muscle tissues of a body part of the user along different directions when the body part rolls on the roller and transitions from coming in direct rolling contact with a segment of the first surface texture to coming in direct rolling contact with another segment of the second surface texture.

9. The method of claim 1, wherein each opposing nub end of each nub disposed at a side of the base layer applies and sustains pressure on a body part of the user to massage and release muscle tension from muscle tissues of the body part when the body part is pressed against the side of the base layer.

10. The method of claim 1, wherein the plurality of nubs having a radial cross-section that is semi-elliptical with a nub radius shorter than a nub length with the nub length being between 49.5 mm to 59.5 mm, or a radial cross-section that is trapezoidal with a nub depth shorter than the nub length with the nub length being 20 mm or 41 mm.

11. The method of claim 3, wherein the overlaying comprises applying the covering to the bottle by way of a hot press mold and glue, the covering extending over more than half of the top-to-bottom length of the bottle, and a wall thickness of the bottle further supporting the covering.

12. A method for manufacturing a self-massage roller, comprising:

forming a bottle from stainless steel, wherein the bottle is configured to support a body weight of a user, and the bottle has a top-to-bottom length extending from a top end of the bottle to a bottom end of the bottle; and attaching directly a plurality of nubs on a portion of an outer surface of the bottle;

wherein the plurality of nubs protrude from the outer surface in a direction radially away from the outer surface of the bottle, the plurality of nubs together forming a textured surface for myofascial release, the plurality of nubs distributed about the outer surface as alternating segments of at least two different surface textures, the alternating segments comprising at least one segment of a first surface texture and at least one other segment of a second surface texture;

wherein each segment of the first surface texture comprises a single array of nubs extending from a first side of the portion to a second side of the portion, all nubs of the single array having the same shape and dimensions, each nub of the single array vertically spaced apart from another nub of the single array, and all nubs of the single array arranged longitudinally along a first direction perpendicular to the top-to-bottom length of the bottle; and wherein each segment of the second surface texture comprises a first sequence of nubs with alternating nub lengths arranged in a first alternating order and a second sequence of nubs with alternating nub lengths arranged in a second alternating order that is complementary to the first alternating order, each nub of each sequence having a nub length that is either shorter or longer than another nub of the same sequence that is directly adjacent to the nub, each nub of each sequence horizontally spaced apart from another nub of the same sequence, all nubs of each sequence arranged longitudinally along a second direction parallel to the top-to-bottom length of the bottle, all nubs of each sequence having the same shape, and the first sequence disposed above the second sequence, such that each nub of the first sequence is positioned directly above and vertically spaced apart from another nub of the second sequence having a nub length that is either shorter or longer than the nub of the first sequence.

13. The method of claim 12, wherein the plurality of nubs having a radial cross-section that is semi-elliptical or trapezoidal.

14. The method of claim 12, wherein:

the bottle comprises a body including the outer surface, the top end, and the bottom end;

a bottom closing the bottom end; and a top at the top end to allow access to an interior of the bottle.

15. The method of claim 14, wherein:

the alternating segments are arranged longitudinally along different directions relative to the top-length of the bottle;

each nub of the first sequence of nubs includes a first nub end that is disposed along the first side of the portion and that is in horizontal alignment with each other first nub end of each other nub of the first sequence; and each nub of the second sequence of nubs includes a second nub end that is disposed along the second side of the portion and that is in horizontal alignment with each other second nub end of each other nub of the second sequence.

16. The method of claim 12, wherein the bottle has a wall thickness of 0.5 mm.

17. The method of claim 15, wherein the wall thickness of the bottle, dense material of each nub, and a nub length of each nub together support the body weight of the user when the roller is placed horizontally on a side of the outer surface and a body part of the user is positioned on top of a portion of the plurality of nubs.

18. The method of claim 12, wherein each nub includes a pair of opposing nub ends, and one or more opposing nub ends of one or more nubs of the plurality of nubs apply and sustain pressure on one or more body parts of the user when the one or more body parts roll on the roller and come in direct rolling contact with the one or more nubs, the one or more opposing nub ends massaging and releasing muscle tension from different muscle tissues of the one or more body parts.

19. The method of claim 12, wherein the alternating segments massage muscle tissues of a body part of the user along different directions when the body part rolls on the roller and transitions from coming in direct rolling contact with a segment of the first surface texture to coming in direct rolling contact with another segment of the second surface texture.

20. The method of claim 12, wherein each opposing nub end of each nub disposed at a side of the portion applies and sustains pressure on a body part of the user to massage and release muscle tension from muscle tissues of the body part when the body part is pressed against the side of the portion.

* * * * *